United States Patent [19]

Ouellette et al.

[11] Patent Number: 4,970,840

[45] Date of Patent: Nov. 20, 1990

[54] WINDOW ASSEMBLY AND GRILLE

[76] Inventors: Raymond Ouellette, 28 du Belvédère Avenue, Sainte-Julie, Canada, J0L 2C0; Patrick Gagnon, 3, rue de Coursol - #106, Victoriaville, Canada, G6P 3Y7

[21] Appl. No.: 383,073

[22] Filed: Jul. 21, 1989

[51] Int. Cl.[5] ..... E04C 2/38

[52] U.S. Cl. ..... 52/311; 52/456; 52/507; 52/656

[58] Field of Search ..... 52/656, 665, 456, 664, 52/667, 668, 311, 717, 507, 663

[56] References Cited

U.S. PATENT DOCUMENTS

| | | | |
|---|---|---|---|
| 3,308,593 | 3/1967 | Smith | 52/456 |
| 3,340,661 | 9/1967 | Krieger | 52/665 X |
| 3,474,587 | 10/1969 | Martin | 52/507 X |
| 3,592,493 | 7/1971 | Goose | 52/656 X |
| 3,866,380 | 2/1975 | Benson | 52/656 |
| 4,854,100 | 8/1989 | La See | 52/456 |

*Primary Examiner*—David A. Scherbel
*Assistant Examiner*—Creighton Smith

[57] ABSTRACT

A glazing unit having a quadrangular sash mounted to an opening of a wall or of a door and carrying a large glass pane. A decorative grille is applied against the surface of the glass pane. The grille is releasably connected to the sash thanks to invisible clips. The grille is made of muntin rods which are easily assembled, thanks to double headed couplers, joining intersecting sections of the muntin rods, and also single head couplers, joining the muntin rods to the peripheral frame of the grille.

7 Claims, 3 Drawing Sheets

Fig. 5
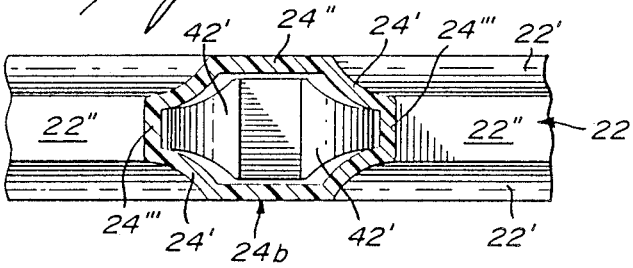
Fig. 6
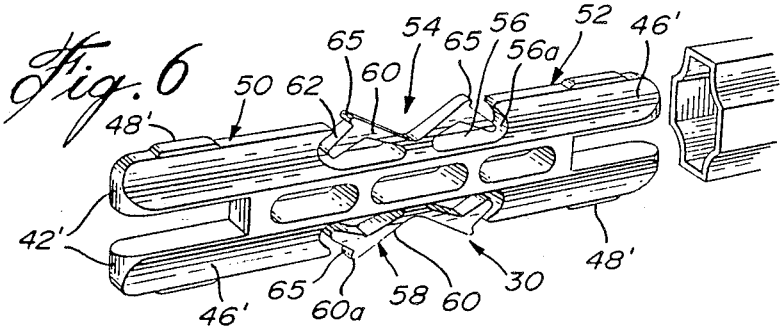
Fig. 7
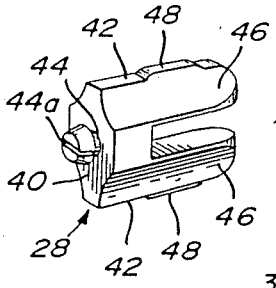
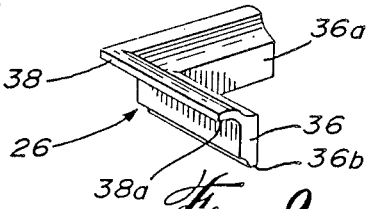
Fig. 9
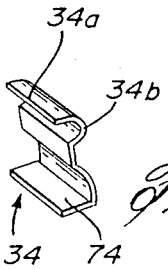
Fig. 8

WINDOW ASSEMBLY AND GRILLE

FIELD OF THE INVENTION

This invention relates to glazing units, and more particularly to a grille and to coupling means for removably securing the grille against the glass pane of the glazing unit.

BACKGROUND OF THE INVENTION

One drawback of existing decorative grilles for door lites is that they are usually constructed as a single molded unit which in most cases is an integral part of the door lite sash and in other cases is detachable from said sash. This requires different molds for making grilles to fit sashes of various sizes. Moreover, a drawback of existing detachable grilles is that, although it is known to provide clip means for releasably fitting a decorative grille into a window sash, such clip means remain visible and detract from the decorative aspect of the grille and window. Certain known types of clip means produce air passages between the sash and the glass pane.

OBJECTS OF THE INVENTION

A first major object of the invention is to provide an ornamental grille for a window such as a door lite which can be readily attached to and removed from the window sash and which is itself made of muntin bars easily assembled by novel connectors so as to make grilles of various dimensions.

A second major object of the invention is to provide invisible or hidden clip means for easily and releasably fitting an ornamental grille to a glazing unit sash the clip means not producing air leakage between the sash and the glass panes.

SUMMARY OF THE INVENTION

In accordance with the hereinabove stated objects of the invention, there is disclosed a grille to be used in association with a glazing unit including a window sash made of two quadrangular halves, a glazing unit pane retainingly taken in sandwich between said sash halves, said sash being edgewisely mounted to the edge portion of a window opening made in a wall or door. The decorative grille is designed to be applied against said glazing unit pane and defines a peripheral frame having an outer portion overlying said sash and an inner portion extending towards said glazing unit pane inwardly of said sash, and clips to releasably interconnect said grille to said sash; wherein each clip defines a strip having a main section which is mounted between said sash and said inner portion of said grille frame, and a bottom flat flange frictionally inserted between said sash and said glazing unit pane; said strip and grille frame being characterized in that they include complementary retaining means to retain said grille frame to said sash.

Preferably, said retaining means of the clip includes a bulge formed by said main section of the clip and a complementary groove formed in the inner section of said grille frame, said bulge releasably engaging said groove.

Advantageously, said grille frame is made of separable sides and said grille includes a number of regularly-spaced rows of muntin rods and of a number of regularly spaced columns of muntin rod segments mounted in said grille frame, first connector means to releasably interconnect said sides, second connector means to releasably connect said muntin rod segments to said rods and third connector means to connect said rods and rod segments to said sides; said connector means being characterized in that they enable easy assembly of the muntin rods and muntin rod segments. It would be desirable that said second and third connector means each defines a U-shape block, said block being made of a semi-rigid material wherein the two side legs of the U may be biased toward each other said rods and rod segments being hollow, wherein said blocks frictionally engage their hollow. Also preferably, the block of said third connector means includes a headed stud snappingly engaging into a hole of said grille frame side.

Advantageously, said rods and rod segments are edgewisely tapered so as to define an hexagonal shape in cross-section; and said second and third connector means further include two thin opposite projections on the exterior face of said block side legs, said projections in frictional contact with the widest portion of the corresponding said rod or rod segment.

Profitably, said second connector means defines an elongated body made of a semi-rigid material and consisting of three sections, to wit an intermediate section and two opposite end sections each of which end sections defining a similar U-shape block wherein the two side legs of the U may be biased toward each other; said rods and rod segments being hollow, wherein said blocks engage the hollows of said rod segments and said rods having through-bores at regular lengthwise intervals and through which is releasably engaged said intermediate section of said elongated body: and friction means, to induce displacement of said block side legs one toward the other when said blocks are inserted into rod segments.

Preferably, said elongated body intermediate section includes two opposite lengthwise cavities, each cavity including releasable locking means to immobilize said elongated body into said through-bore against lengthwise displacement.

Preferably, said locking means includes two elbowed arms anchored at the centre of each cavity and forming a somewhat extended wing bird like figure said arms being made of a semi-rigid material and each defining a projecting elbow extending outwardly from the area of the corresponding cavity; these elbows constituting abutting surfaces for the corner edges of the adjacent said rods and rod segments, wherein the "sinking" capability of the two said arms provide for adjustable securement of the rod segments to the rods.

BRIEF DESCRIPTION OF THE DRAWINGS

FIG. 5 is a cross-sectional view taken along lines 5—5 of FIG. 2 and of FIG. 4, showing the end face of the connector;

FIG. 6 is a perspective view of the double head grille connector, showing how one end thereof may engage a polygonal muntin rod member of the glazing unit grille;

FIG. 7 is a perspective view of a second embodiment of grille connector, having only one end or head, and which is also seen at the bottom left corner of FIG. 4;

FIG. 8 is a perspective view of a grille mounting clip according to the invention and which is also seen in cross-sectional view on the right side of FIG. 3; and FIG. 9 is a perspective view of a corner connector, for interconnecting two orthogonal grille members, the latter connector being also shown in plan view at the upper left corner of FIG. 4.

DETAILED DESCRIPTION OF THE INVENTION

Figure 1:
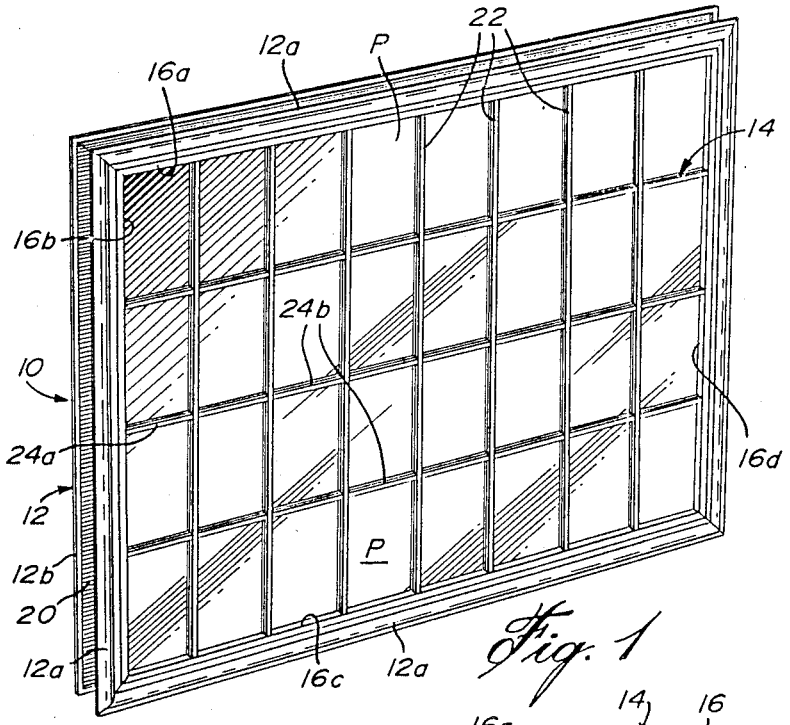
FIG. 1 is a perspective view of an embodiment of glazing unit according to the invention.

Glazing unit or window 10 consists of a quadrangular sash 12, made from two similar halves 12*a*, 12*b* spacedly interconnected in conventional fashion by locking bolts (not shown). A pair of spaced glass panes P (only one being shown in FIG. 3) are taken in sandwich between the two sashes 12*a*, 12*b*, the glass panes being spaced by spacing tubes 76. Glazing unit is to be secured to a door or wall W within opening 66. Sash half 12*a* or 12*b* has a generally L-shaped cross-section, with its outer leg 13*a* pressed against panel with the interposition of a sealing strip 70 retained in a groove 72 of leg 13*a*, while the inner leg 13*b* abuts against glass pane P with the interposition of a sealing strip 71 retained in a groove 73 of leg 13*b*. A decorative tubular grille 14 is applied against one glass pane P and frictionally releasably locked to the sash 12 by clip means 34, detailed later.

In accordance with the Invention, grille 14 consists of a peripheral square frame 21, being crossed by a number of muntin rods 22 extending in spaced parallel rows between opposite top and bottom segments of sash 12*a*, and a plurality of short muntin rod segments 24*a*, 24*b* also extending in spaced parallel columns orthogonally to the rods between the side segments of sash 12*a*. Rod segments 24*a* are at the periphery of the grille, while rod segments 24*b* extend between and endwisely interconnect two consecutive muntin rods 22. A grille is therefore formed, wherein a plurality of quadrangular openings 32 are defined by the n rows of vertical rods 22 and m columns of horizontal rod members 24*a*, 24*b* for $(n+1)(m+1)$ openings 32; i.e., with $n=7$ and $m=3$ in the embodiment of glazing unit of FIG. 1, there are 32 such openings. The large quadrangular glass pane F is mounted between sash 12*a*, 12*b* exteriorly of the plane of muntin rods 22 24*a*, 24*b*, wherein these rods therefore have a solely decorative purpose. Muntin rods and rod segments 22, 24*a*, 24*b* are endwisely tapering, i.e. of substantially octagonal shape in cross-section as suggested in FIG. 5.

The adjacent segments 16*a*, 16*b*, 16*c*, 16*d* making the peripheral frame 16 of grille 14 are interconnected at their ends by first connector members 26. Muntin rod segments 24*a* are connected to grille segments 16*b* or 16*d* by second connector members 28 and to muntin rods 22 by third connector members 30. The whole grille frame 16 is retained to the glazing unit sash 12*a* by a number of retaining clips 34. [Connector members 28 may very well also interconnect the end sections of muntin rods 22 to grille frame segments 16*a* and 16*c*].

Members 26, 28, 30 and 34 will be detailed hereinbelow.

Figure 3:
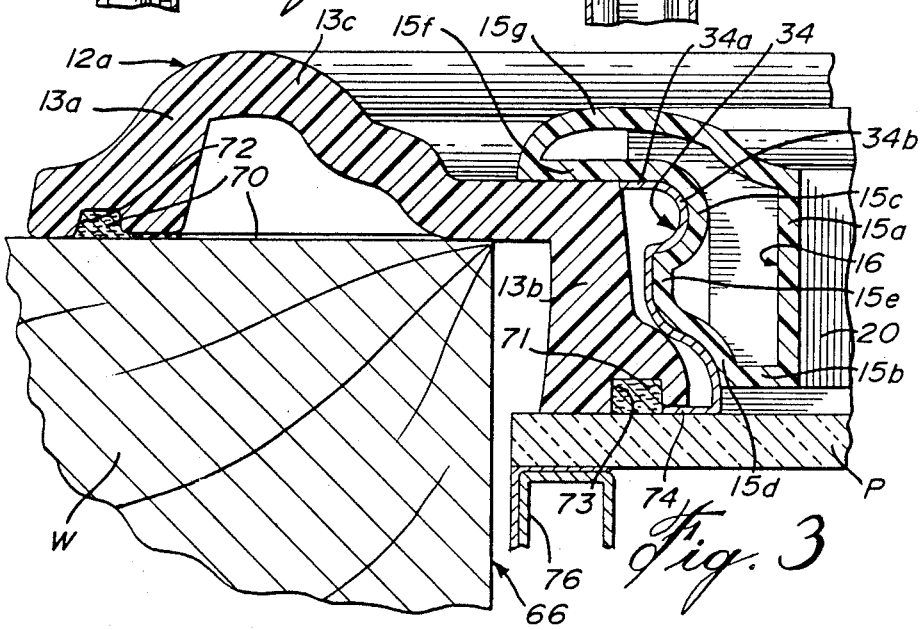
FIG. 3 is an enlarged cross sectional view taken along lines 3—3 of FIG. 2.

First connector member 26 is shown in FIGS. 3 and 9. Connector 26 consists of a right angle bar 36 from the top end of which upwardly transversely extends a flange 38. Bar 36 has flat exterior and bottom walls 36*a*, 36*b*, while the interior lower edge thereof at 36*c* is inwardly concavely curved. Flange 38 has a flat underface 38*a* and is curved or offset at its inner portion which merges with the top end of flat exterior wall 36*a*. Connector 26 may be made of a semi-rigid plastic material. Connector 26 is destined to engage the open bevelled ends of the hollow of two adjacent orthogonal grille frame segments 16*a*–16*b* or 16*b*–16*c* or 16*c*–16*d* or 16*d*–16*a*. Hence, each half section of connector 26 conforms to the general shape of the hollow of segments 16*a*–16*d*.

In operation, firstly, one slides the first end of connector 26 into the hollow 21 of a first segment 16*a*–16*d*, the other end (at right angle to the first) of the connector 26 being thereafter engaged by the hollow 21 of a second segment 16*a*–16*d*, wherein grille frame 16 can become an integral unit by friction fit.

Figure 4:
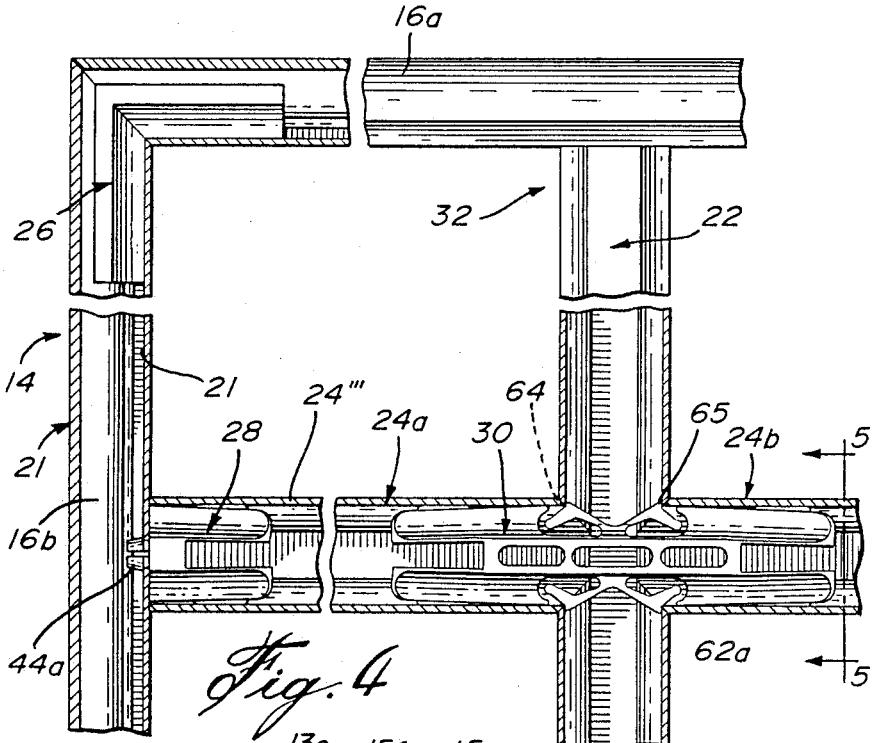
FIG. 4 is a partial, broken view of the grille, partly in longitudinal sectional view so as to show the double-ended grille rod connectors of the invention.

Connector 28 as shown in FIGS. 4 and 7 is generally U-shape, defining a base leg 40 and two side legs 42. A stud 44 protrudes from the connector base 40, parallel to side legs 42. The stud 44 is destined to extend through a hole of a wall of a segment 16*a*–16*d*, into its hollow 21, wherein the split head 44*a* of stud 44 will be inserted and will snap in position. Each side leg 42 includes two opposite inclined shallow lengthwise grooves 46 designed to follow the tapering edge portions 22' (FIG. 2) of rods 22 and 24' of rod segments 24*a*–24*b*. Connector 28 is made of semi-rigid plastic, so that its two legs 42 can be slightly inwardly biased. The exterior wall of each side leg 42 includes an intermediate thin projection 48, which abuts against the main flat untapered rod part 22'' or 24'' when connector 28 is engaged by a rod 22 or rod segment 24*a* or 24*b*; this in effect biases the two legs 42 of the connector 28 toward each other, as suggested in FIG. 4 (bottom left area). This will in turn frictionally lock the connector 28 in place, i.e. will secure rod 22 or 24*a* or *b* to the grille frame 16.

The other connector 30 is clearly shown in FIG. 6, and also shown in FIGS. 4 and 5. The two opposite end sections 50, 52 of connector 30 are mirror-images of each other, and each is similar to connector 28 but for the stud 44. Thus, each section 50, 52 defines two legs 42', each having two opposite inclined lengthwise grooves 46' and a thin lateral projection 48'. The intermediate section 54 joins sections 50 and 52 in integral fashion. Section 54 includes two lengthwise opposite cavities 56, within the plane passing through the four projections 48'. Each cavity 56 defines two curved ends 56*a*, and a V-shaped frame 58 defining two outwardly diverging arms 60, 60 projecting from the intermediate section of the cavity 56. The apex of the V-frame 58 integrally merges with the core of intermediate section 54, whereas the ends of legs 60 extend slightly beyond the level of projections 48'. From the end portion of each arm 60 but short of the end 60*a* thereof transversely projects a somewhat conical ear 62 which extends towards the registering curved end 56*a* of the connector lengthwise cavity but at a distance therefrom. Each arm 60 defines an outward step 65.

It can now be understood from FIG. 4 that each connector 30 is designed to extend through a horizontal square bore 64 made in rod 22. The step 65 defined between an ear 62 and the registering arm end 60*a* constitutes an abutment surface against which will seat with a snap action the peripheral edge of muntin rod 22. The extended wing bird like shape of each semi-rigid V-frame 58, provides same with the capability, of forcing sinking into the cavity 56 of connector 30, under a compressive biasing force applied thereagainst toward the bottom of the cavity 56. since ears 62 are spaced from the proximate underface of the intermediate section 54, its shape gives connector 30 some adjustability in the coupling of the two coaxial rod elements 24a or 24a–24b with their vertical rod 22.

The connector 30 may be installed in the following manner. First, one end portion or head thereof 50 or 52 is inserted into one through-bore 64 of the vertical rods 22, with connector 30 being in such a rotated position that ears 60a clear web 24'''. While manually inwardly pressing the leading pair of resilient arms 60 to clear the edge of hole 64, the connector is pushed further so that its intermediate section 54 also extends through bore 64 and becomes centered relative to rod 22, and steps 63 snap into locking position within rod 22. In this way, the connector 30 is locked in position, i.e. that it cannot slide lengthwisely by simply pulling it or pushing it. Hence, sections 50, 52 of the connector 30 then project from opposite sides of rod 22, as suggested in FIG. 4. It is a simple matter thereafter to endwisely push a rod segment 24a or 24b over a section 50 or 52, whereby the latter will become frictionally secured to muntin rod 22 because of projections 48'.

Figure 2:
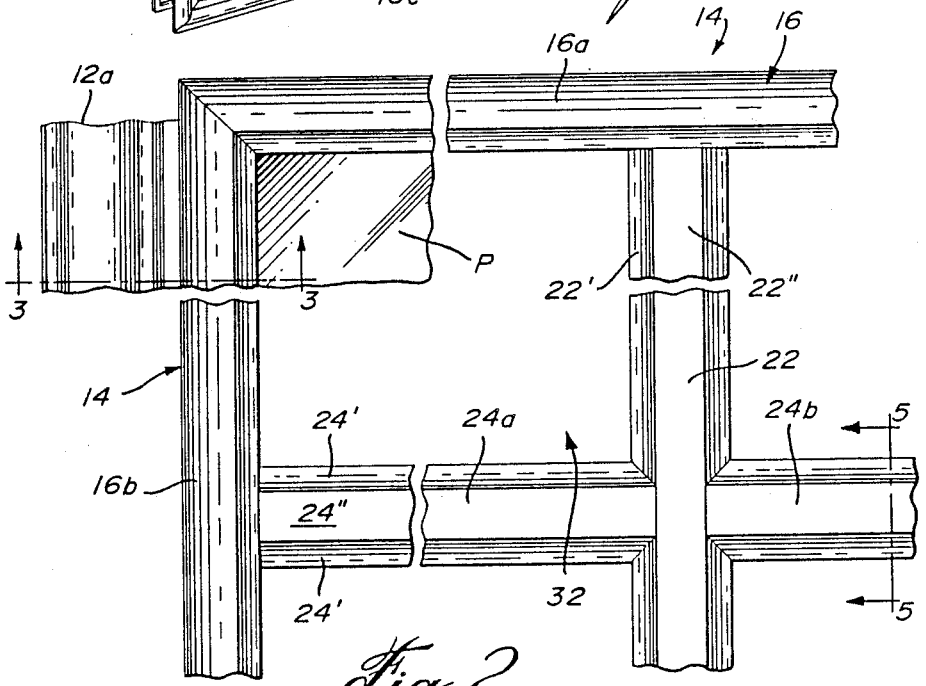
FIG. 2 is an enlarged partly broken plan view or one corner portion of the glazing unit, with the grille fixed thereto

As can be inferred from FIGS. 2–3, connector member 34 forms a resilient metallic clip, destined to facilitate frictional edgewise releasable securement of the whole grille frame 16 to the sash 12a. Clip 34 is preferably made of a thin sheet of stainless steel; it has a flat base flange 74 which is frictionally inserted between leg 13b and glass pane P short of flexible sealing strip 71. A few clips 34 are thus positioned spacedly around sash 12. Since inner sash part 13d (FIG. 3) on the inside of the groove housing gasket 71, is thin and therefore flexible, it will locally flex to allow insertion of clip base flange 74 and yet outer sash part 13e will remain in contact with glass pane P. Thus, no air will pass between pane P and sash 12a, even if there is no gasket 71, which is usually the case on the inside of the unit 10 where grille 14 is located.

Each grille frame segment 16a–16d defines a flat short inner wall 15b, and a flat interior wall 15a, orthogonal to wall 15b. A flange 15f–15g transversely upwardly extends from the exterior end of wall 15a to form an exterior convex bulge 15g, a flat underside 15f being defined in register with said exterior end of wall 15a. Flange underside 15f is destined to flatly abut against the flat part 13c of the sash 12a (or *b*), as illustrated in FIG. 3. The exterior wall 15e of each grille frame segment 16a–16d forms a concave involution or groove 15c at its upper section, which merges with flange underface 15f, and is downwardly interiorly curved at its lower section 15d, to merge with inner wall 15b of segments 16a–d.

The portion of clip 34 which extends outwardly from base flange 74 conforms to the shape of sections 15f, 15c, 15e, 15d, except that its exterior section 34a is not as long as registering flange underside 15f and abuts against leg 13b. Below section 34a, clip 34 defines a bulge 34b. When grille 14 is pressed against glass pane F within sash half 12a, grille frame segments 16a to 16b, being resilient, will bend inwardly of the grille 14 to clear bulges 34b and they snap back with bulges 34b releasably engaging groove 15c. Hence, clip 34 is hidden by the overlying parts 15f, 15g of grille 14. The grille 22, 24a, 24b may have any number of rows columns of rods rod segments, to fit glazing units sashes 12 of dIfferent shapes and sizes.

I claim:

1. In combination, a quadrangular glazing unit sash, a glazing unit pane edgewisely carried by said sash, said sash being edgewisely mounted to the edge portion of a quadrangular panel opening, a decorative grille applied against said glazing unit pane and defining a peripheral quadrangular frame having an outer portion overlying said sash and an inner portion extending towards said glazing unit pane inwardly of said sash, and clips to releasably interconnect said grille to said sash; wherein each clip defines a strip having a main section which is mounted between said sash and said inner portion of said grille frame and a bottom flat flange frictionally inserted between said sash and said glazing unit pane; said strip and grille frame being characterized in that they include complementary retaining mans to retain said grille frame to said sash; wherein said grille frame is made of separable sides and said grille includes a number of regularly-spaced rows of muntin rods and a number of regularly spaced columns of muntin rod segments mounted in said grille frame, first connector means to releasably interconnect said sides, second connector means to releasably connect said muntin rod segments to said rods and third connector means to connect said rods and rod segments to said sides.

2. A glazing unit as defined in claim 1, wherein said second and third connector means each defines a U-shape block, said block being made of a semi-rigid material wherein the two side legs of the U may be biased toward each other; said rods and rod segments being hollow, wherein said blocks frictionally engage their hollow.

3. A glazing unit as defined in claim 2, wherein the block of said third connector means includes a headed stud snappingly engaging into a hole of said grille frame side.

4. A glazing unit as defined in claim 3, wherein said rods and rod segments are edgewisely tapered so as to define an hexagonal shape in cross-section; and further including two thin opposite projections on the exterior face of said block side legs, said projections in frictional contact with the widest portion of the corresponding said rod or rod segment.

5. A glazing unit as defined in claim 1, wherein said second connector means defines an elongated body made of a semi-rigid material and consisting of three sections, to wit an intermediate section and two opposite end sections each of which end sections defining a similar U-shape block wherein the two side legs of the U may be biased toward each other; said rods and rod segments being hollow, wherein said blocks engage the hollows of said rod segments and said rods having through-bores at regular lengthwise intervals and through which is releasably engaged said intermediate section of said elongated body; and friction means, to induce displacement of said block side legs one toward the other when said blocks are inserted into rod segments.

6. A glazing unit as defined in claim 5, wherein said elongated body intermediate section includes two opposite lengthwise cavities, each cavity including releasable locking means to immobilize said elongated body into said through-bore against lengthwise displacement.

7. A glazing unit as defined in claim 6, wherein said locking means includes two elbowed arms anchored at the centre of each cavity and forming a somewhat extended wing bird like figure; said arms being made of a semi-rigid material and each defining a projecting elbow extending outwardly from the area of the corresponding cavity; these elbows constituting abutting surfaces for the corner edges of the adjacent said rods and rod segments, wherein the "sinking" capability of the two said arms provide for adjustable securement of the rod segments to the rods.

* * * * *